United States Patent [19]

Edstrom

[11] Patent Number: 4,575,151

[45] Date of Patent: Mar. 11, 1986

[54] CHAIR TILTING MECHANISM

[75] Inventor: Andrew H. Edstrom, San Jose, Calif.

[73] Assignee: Maridyne, Inc., Palo Alto, Calif.

[21] Appl. No.: 532,234

[22] Filed: Sep. 13, 1983

[51] Int. Cl.[4] ..... A47C 3/00

[52] U.S. Cl. ..... 297/304; 297/325; 297/333

[58] Field of Search ..... 297/304, 333, 314, 325; 16/373; 248/372.1

[56] References Cited

U.S. PATENT DOCUMENTS

| | | | |
|---|---|---|---|
| 3,659,819 | 5/1972 | Wolters | 297/304 |
| 3,823,980 | 7/1974 | Harnick | 297/325 |
| 3,868,144 | 2/1975 | Lie | 297/304 |
| 4,185,803 | 1/1980 | Kalvath | 297/333 X |
| 4,295,625 | 10/1981 | Large | 297/304 |

*Primary Examiner*—James T. McCall

*Attorney, Agent, or Firm*—Townsend and Townsend

[57] ABSTRACT

A mechanism for connection to a chair and to a base for allowing the chair to tilt forward and backward and from side-to-side relative to the base when the base is supported on a floor. The mechanism includes a support in the form of a housing mounted on a base by horizontal pin for forward and backward tilting movement on the base. A plate is mounted on the support for pivotal movement from side-to-side, the plate adapted to be coupled to the underside of the chair. A pair of torsion bars is carried by the support and serves to exert a spring bias force on the support when the chair is tilted backwardly relative to the base. The two torsion bars can be coupled in a manner to limit the spring bias effect of one of the torsion bars so that adjustments in the spring loading can be made as to the size and weight of a person sitting in the chair. A third torsion bar controls the spring bias force exerted on the plate secured to the underside of the chair during side-to-side movement; thus, the chair can be tilted forwardly and backwardly and from side-to-side, yet spring bias forces will be exerted on the chair to return the chair to an equilibrium position. Several embodiments of the mechanism are disclosed.

38 Claims, 13 Drawing Figures

CHAIR TILTING MECHANISM

This invention relates to improvements in back tiltable chairs, such as office executive type chairs, and the like, and more particularly, to a mechanism for permitting forward and side-to-side tilting as well as the usual backward tilting of a chair.

BACKGROUND OF THE INVENTION

Tilting mechanisms for attaching a seat or chair to a base or pedestal are well known and have been in use for many years. Generally, such mechanisms are constructed to allow only rearward tilting movement of a chair with the application of an adjustable spring bias force on the chair to return it to a vertical equilibrium position when desired by the occupant or when the chair is not in use. Although this is an improvement over rigidly positioned chairs, in allowing the occupant the option of a semi-reclining position which transfers some of the pressure of sitting from the thighs to the spine, they fall far short of what can be provided by a fully reactive, omnidirectional, spring biased chair support responsive to all the body movements of an occupant such as the one that shall be described herein.

SUMMARY OF THE INVENTION

Since the introduction of the aforementioned tilt-back chair devices, largely intended for the executive set, millions of workers now have sedentary jobs requiring long hours sitting at various work stations, such as those involving electro-mechanical and electronic assembly or word processing and computer graphics as well as a host of others. Each job has its own unique set of positions and necessary movements of the worker while seated. Rigid chairs resist these movements, forcing the body into unnatural and stressful positions, resulting in early fatigue, pain and occasional back injury. As examples: assembly work with a microscope, drafting and desk work, require a lot of forward leaning in a chair. A rigid chair, in this circumstance, will have its forward seat edge at an acute angle under the thighs. This presents a rather sharp edge which will press deeply into the thigh muscles behind the knee. This is extremely uncomfortable and greatly restricts blood flow. Very soon the occupant must interrupt his or her activity and seek relief, repeating the process often during the day.

In a chair that tilts forward with the user, as does the present invention, the thighs remain much more flat on the seat and relief is seldom needed. Work, at wide stations or three-sided consoles, demands reaching far to the right and left for controls, keyboards and instruments. These movements are severely restricted in a rigid chair. The occupant is required to either move the entire chair into position or to incline the body in the desired direction by shifting onto one thigh or the other, thus increasing the stress on those members. In addition to this, the muscles in the back must constantly work to keep the pelvis and spine in a comfortable, more or less, perpendicular alignment as possible, in that inclined position. The natural tendency is for the pelvis to move to a level position with the seat while the spine is at a steep angle relative to it.

In a chair with arms, this problem is aggravated. The arm will contact the body just above the pelvis and limit its angle of inclination. The spine must then assume a more extreme angle relative to it in order to achieve the desised reach. Neither condition is comfortable and on occasion can be injurious. A chair, supported on the present invention, will in the same circumstance, automatically incline in the direction of the occupant, and thus maintain the body in a much more natural sitting position relative to the chair. The seat, backrest and arms, if any, all move in the same direction and substantially to the same degree as the user. Thus, the occupant is still sitting almost flat on the seat and the angulation between pelvis and spine are very near to normal and under very little muscular tension.

Until now, the back-tilted chair position has not been considered an active working position, but is one intended solely for intermittent physical relief; hence, its hitherto popular and almost exclusive use in the office by the harried executive seeking a restful interlude. It could, however, be very useful in occupations utilizing large displays such as computer graphics and radar screens as well as drafting and artwork done on more or less vertical boards. The contemplative and evaluative interludes of such jobs, as well as planning subsequent effort, can be very productively executed in that position. Although the tiltback position is not new, the present invention greatly improves upon this feature. Whereas present supports provide only one back-tilted angle of repose, the present invention is infinitely adjustable from the fully erect position, all the way back to the maximum angle provided. Furthermore, whereas present supports rest upon a hard back stop in the tilted position, the present invention always provides a soft springy stop with an action somewhat comparable to that of a rocking chair. In addition, where present back-tilting supports are adjusted for varying body weights and configurations by manually preloading the biasing spring, the back-tilt adjustment of the present invention does not involve spring preloading at all. The result of this is that the back-tilt adjustment on the present invention can be done with only one finger as opposed to present devices that require a lot of force on a knob with the entire hand or with a wrench.

In the back-tilted position, the chair does not rest upon a hard, dead stop, but is pleasantly soft and springy. The same is true for all other directions of tilt. A comfortable and safe maximum angle or inclination of the chair is automatically maintained. The actual angular value varies slightly depending upon the height and weight of the occupant, but at all times, under normal use, there is a spatial reserve between the movable members of the support and the hard, positive stops provided. This reserve space provides the residual, soft, rocking action at the normal operating angular extremes. In the event of an inadvertent overload, the hard stops will prevent any overtravel, and stop the chair at a safe angle both for the occupant and the torsion bar springs. When the overload has passed, the chair support automatically returns to normal.

The incorporation of this omnidirectional, resilient restraint, at the extremes of normal maximum tilt, is intentional and not just a "gimmick". When a chair can always respond to the occupant's movements, inertial loads on the body are lessened and a subtle, pleasant, relaxing feeling of "floatation" is experienced. Furthermore, the sedentary occupant is much more physically active on such a support because of its reactive movements, and is therefore actually experiencing *mild sedentary exercise* which in itself will delay the need to stand and exercise for relief. The spring bias action associated with the mechanism of the present invention in its simplest form (not providing adjustable, full tilt-back) is achieved with the use of at least a pair of springs, one of the springs being arranged to control the return of the chair to an equilibrium position when the chair is tilted forwardly or backwardly and the other spring being arranged to control the chair during side-to-side tilting movement of the chair. The design of the mechanism is such that both springs are torsion bars and are mounted parallel to each other. Forward and backward tilting movement and side-to-side tilting movement can occur simultaneously, depending upon the direction of body movement of the occupant.

A third torsion bar, oriented parallel to the others, can be associated with one of the other two torsion bars in a manner which allows infinitely adjustable, extended back-tilting to a desired maximum, regardless of the size and weight of the occupant. This adjustment is achieved by means of a load-free knob which controls the degree of interaction between the two series-coupled torsion bars.

Each bar has its own fixed, individual spring rate. The adjustment knob, in its extreme closed position, prevents any transfer of movement to the second torsion bar and allows torsion in only the first bar. This is the stiffest mode of operation and provides the smallest degree of back-tilt. As the adjustment knob is progressively loosened, the first bar is allowed to share its angle of rotation with the second in the series. In this mode, both moving in series, the combined spring rate is reduced roughly in half and the unit allows the chair and occupant to tilt safely backward until the adjustment clearance of the control knob is used up, which locks out the secondary torsion bar and instantly doubles the spring rate because, now, only the first torsion bar is active. Thus, this system uses the back-tilt adjustment knob to control only the angular degrees through which both springs are allowed to work in unison at a lower spring rate and does not preload either spring in the series. Therefore, this unique arrangement of dual, parallel, series-coupled torsion bars can be made to provide, within the design range, infinite angular back-tilt adjustment with only fingertip effort on the part of the user in achieving this adjustment as before mentioned. An additional feature of this arrangement is the soft, comfortable, residual spring cushion support it provides at back-tilt equilibrium compared to the one position, unyielding, hard stop back-tilt feature of the present chair supports.

The primary object of the present invention is to provide an improved chair tilting mechanism which is simple and rugged in construction, is inexpensive to produce, and which provides adjustable spring rates to provide maximum comfort and maneuverability for the occupant of the chair to thereby provide advantages not capable of being achieved with conventional chair tilting mechanisms.

Another object of the present invention is to provide a chair tilting mechanism of the type described, wherein both forward and backward tilting movement and side by side tilting movement can be provided by the mechanism to thereby permit more versatility in the movement of the occupant of the chair, yet such maneuverability is achieved without sacrificing the reliability of the mechanism and comfort for the chair occupant, while keeping the production costs of the mechanism to a minimum.

Other objects of this invention will become apparent as the following specification progresses, reference being had to the accompanying drawings for an illustration of a embodiment of the invention.

Figure 1:
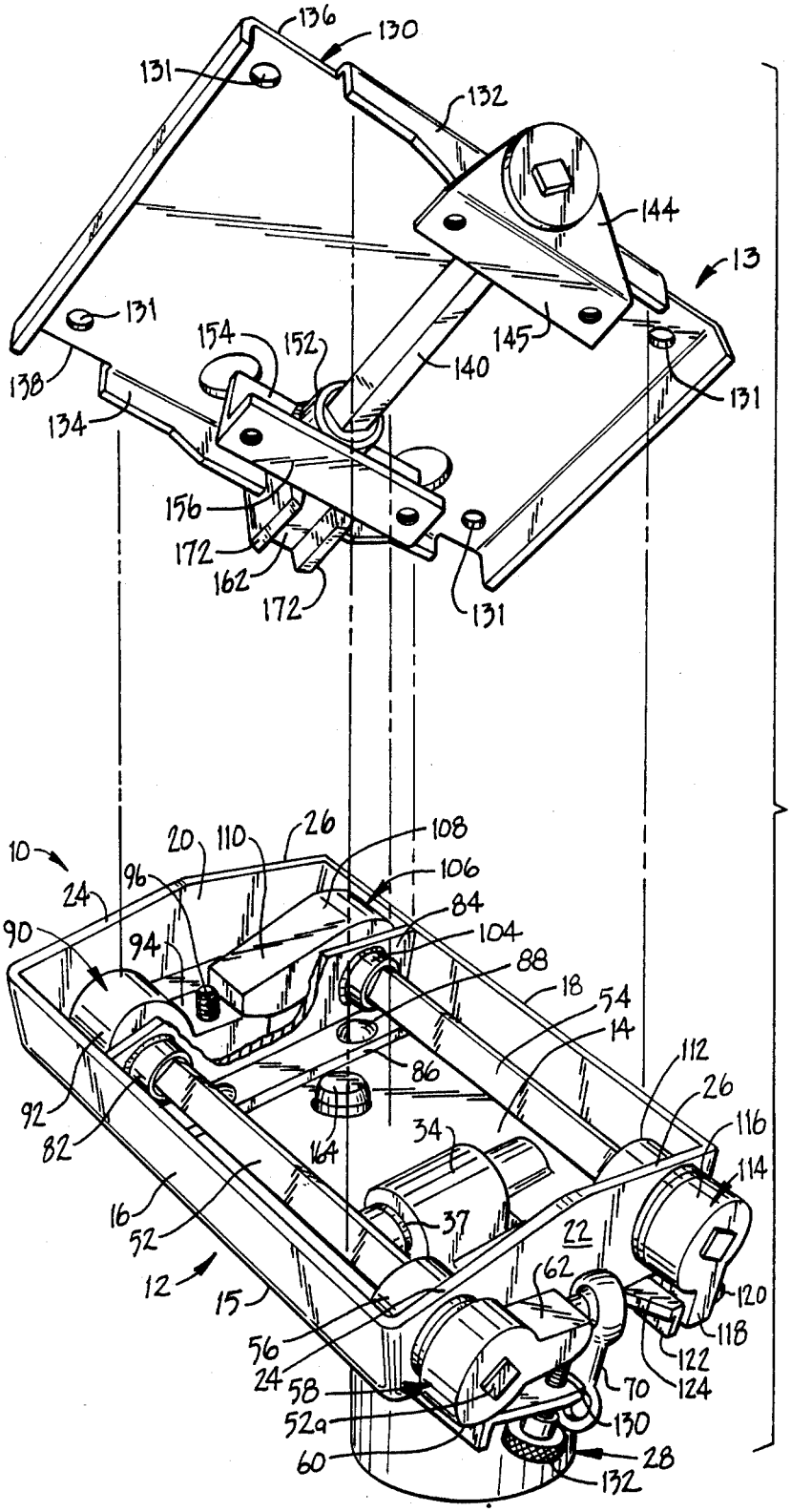
FIG. 1 is a perspective view of the upper and lower main sections of a first embodiment of the chair tilting mechanism of the present invention, showing the torsion bars of the sections for permitting forward, backward and side tilting of a chair coupled to the mechanism, the two sections being separated from each other to illustrate details of construction.

A first embodiment of the chair tilting mechanism of the present invention is broadly denoted by the numeral 10 and includes a lower section 12 and an upper section 13, the two sections being pivotally coupled together as a unit and secured to the underside of a chair for allowing forward and backward tilting as well as side-to-side tilting of the chair when mechanism 10 is mounted on the vertical shaft 44 (FIG. 2) of a base or pedestal (not shown). The chair can therefore serve as a desk chair or for other uses, and mechanism 10 can be quickly and easily connected in any suitable manner, such as by screws, to the underside of the chair.

Figure 3:
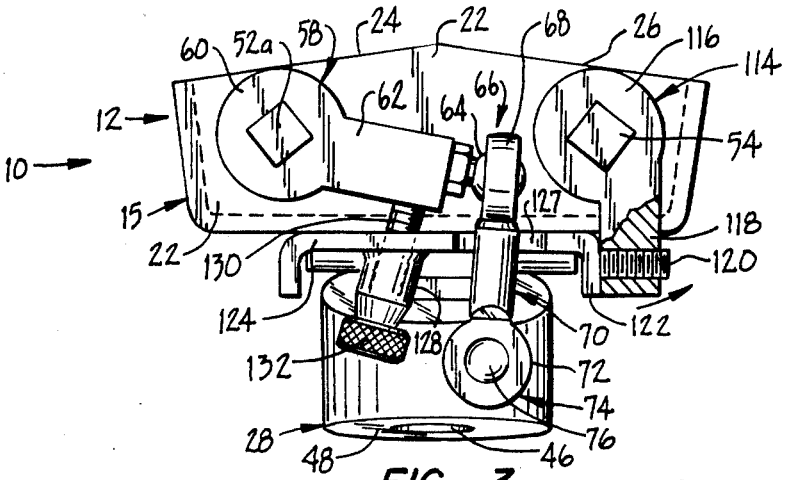
FIG. 3 is a rear elevational view of the lower section of the mechanism, the upper section not shown, parts being broken away and in section to illustrate details of construction.
Figure 4:
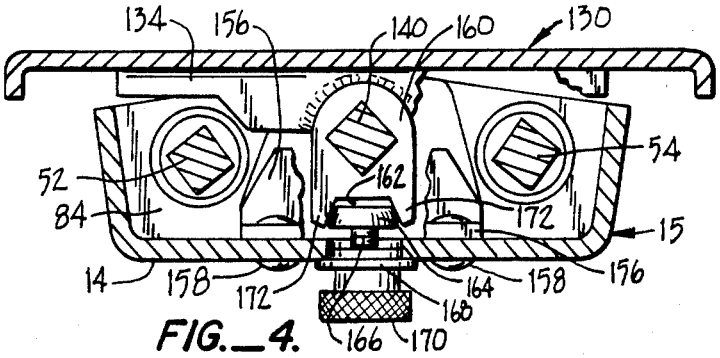
FIG. 4 is a cross-sectional view of the mechanism, looking rearwardly from a location near the front end thereof.

Lower section 12 includes an open top housing or support 15 (FIG. 1) having a generally flat bottom 14, a pair of spaced side walls 16 and 18 and front and rear end walls 20 and 22. Bottom 14, side walls 16 and 18 and end walls 20 and 22 are all rigidly secured to each other, and housing 15 is made from any suitable, high strength material, such as a suitable grade of steel. Side walls 16 and 18 are slightly inclined from the vertical as shown in FIGS. 3 and 4, although they can be vertical, if desired. End walls 20 and 22 are generally vertical and the end walls each have sloping upper marginal edges 24 and 26 as shown in FIGS. 1 and 3.

A generally cylindrical mounting member 28 (FIGS. 2 and 3) is pivotally mounted by a pin 30 (FIG. 2) on bottom 14 for movement about a generally horizontal axis defined by the longitudinal axis of the pin itself. The pin is clamped at the ends thereof in mating concave recesses 32 and 42. A pair of spaced recesses 32 are formed in the lower surface of bottom 14, and a pair of spaced recesses 42 are formed in a bottom plate 38 (FIG. 2) secured by spaced rivets 40 to bottom 14.

Figure 2:
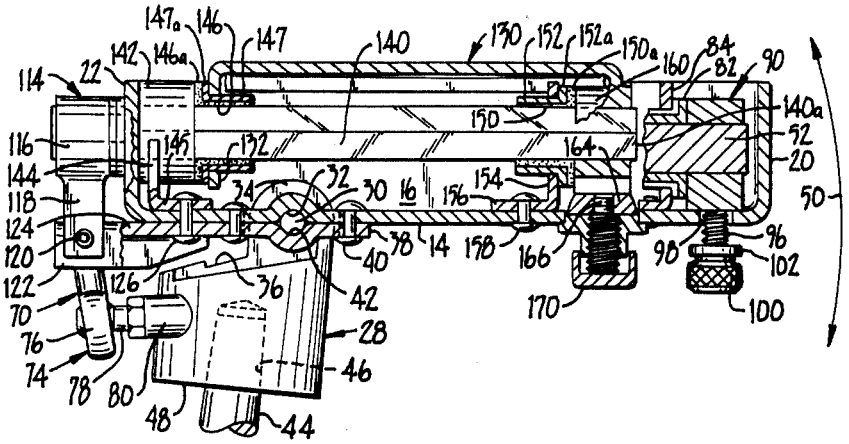
FIG. 2 is a vertical section of the mechanism looking from one side thereof.
Figure 7:
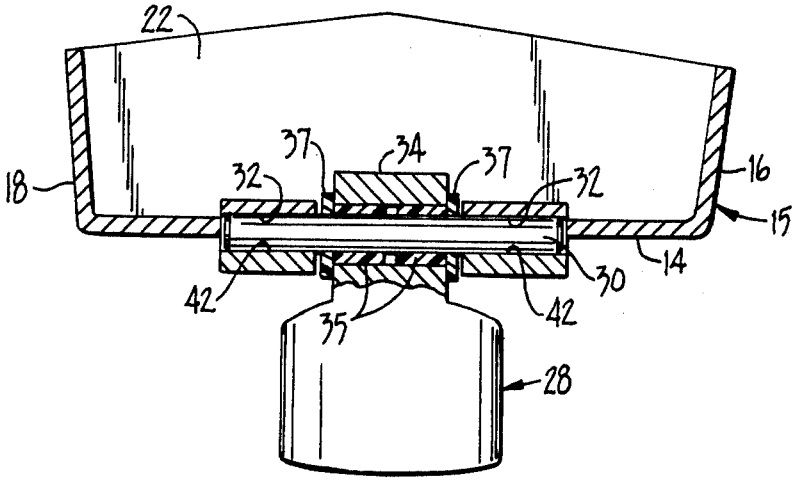
FIG. 7 is a cross-sectional view of the lower section of the mechanism showing the way it is tiltable backwardly and forwardly relative to a base.

Bottom 14 has a hole 33 (FIG. 5) therethrough for receiving a coupling member 34 on the upper end of mounting member 28. Coupling member 34 has a pair of bushings 35 and a pair of side thrust washers 37 (FIG. 7) for journalling pin 30 in coupling member 34, whereby bottom 14 can pivot relative to coupling member 28 about the axis of pin 30 forwardly and rearwardly as indicated by arrow 50 (FIG. 2). Mounting member 28 is typically carried on the upper end of a vertical shaft 44 (FIG. 2) received within a hole 46 extending into the member 28 from the underside 48 thereof.

Figure 5:
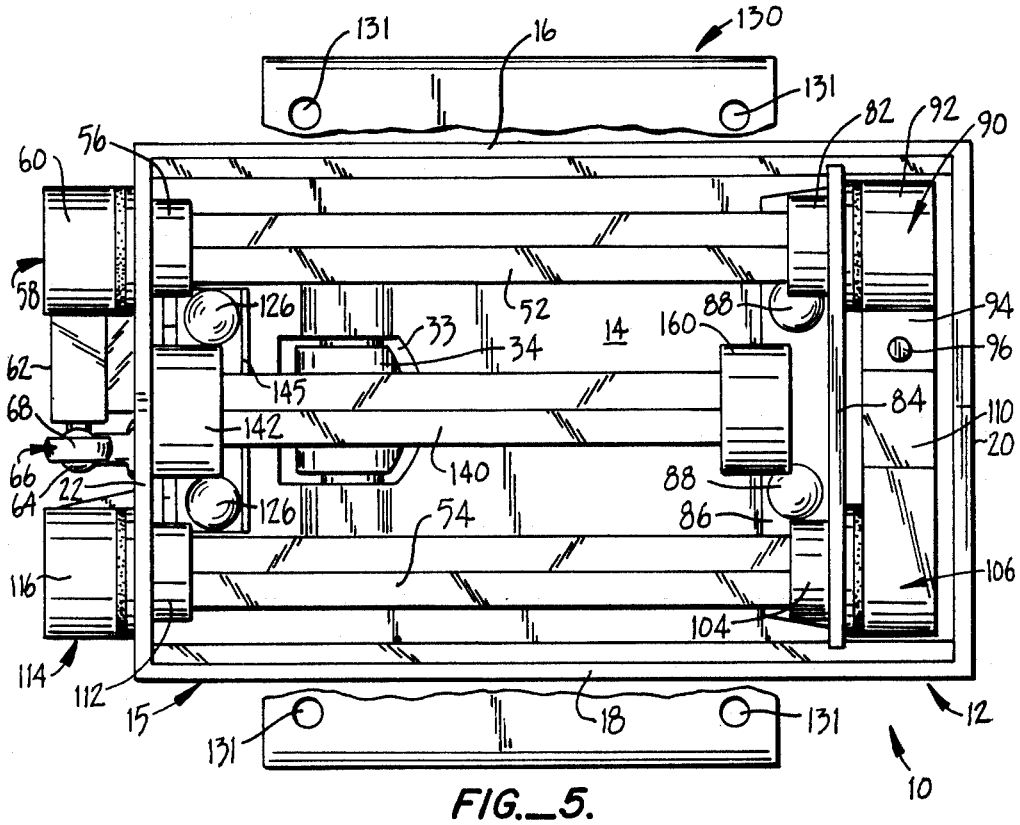
FIG. 5 is a top plan view, partly broken away, of the mechanism.

To provide a spring bias action for housing 15 during forward and rearward tilting of the mechanism relative to mounting member 28, a pair of generally parallel torsion bars 52 and 54 are provided, bar 52 being within housing 12 and extending adjacent to and along side wall 16 and bar 54 being in housing 12 and extending along and generally parallel with side wall 18, all of which is shown in FIGS. 1 and 5.

The rear end of bar 52 passes through rear end wall 22 and is rotatably mounted on wall 22 by a bearing 56 (FIGS. 1 and 5). A first crank element 58 has a head 60 mounted on the rear end 52*a* (FIG. 1) of bar 52. First crank element 58 has an arm 62 extending radially outwardly therefrom and generally parallel with the outer face of rear end wall 22. The outer end of arm 62 has a ball 64 defining a part of a universal joint 66. A second part or ring 68 of U-joint 66 is coupled to a link 70 (FIGS. 1–3). The bottom of link 70 has a ring 72 forming a first part of a second U-joint 74 which includes a ball 76 mounted on the rear end of a shaft 78 (FIG. 2) carried by a leg 80 extending rearwardly from mounting member 28 as shown in FIG. 2. By the use of first crank element 58, link 70, U-joints 66 and 74, and shaft 78, mounting member 28 is coupled with torsion bar 52 so that the tilting movement of housing 15 forwardly and rearwardly relative to mounting member 28 can be affected by the spring characteristics of torsion bar 52.

Figure 6:
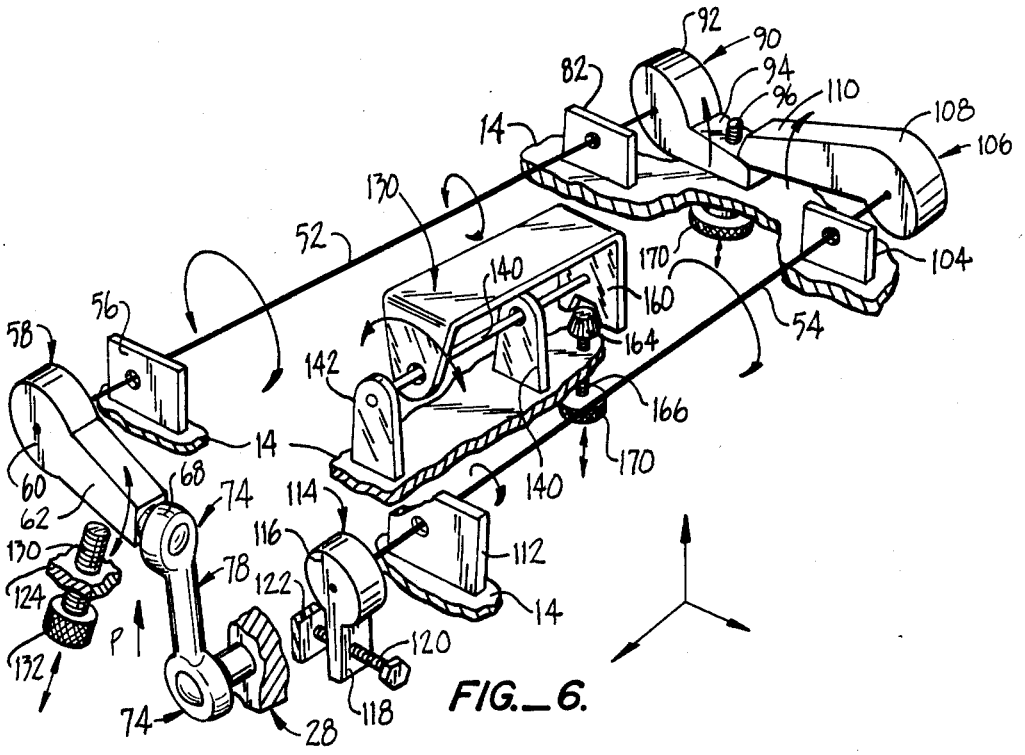
FIG. 6 is a schematic view showing the way in which forces are applied to the torsion bars when the chair to which the mechanism is coupled is tilted forwardly or rearwardly and from side to side.

The forward end of torsion bar 52 is rotatably carried by a bearing 82 (FIGS. 1, 2, and 5), bearing 82 being rigidly mounted on an upright plate 84 (FIG. 2) having a flat, bottom flange 86 (FIGS. 1 and 5) secured by rivets 88 to the upper, flat surface of bottom 14. Plate 84 is generally parallel with and spaced rearwardly from front end wall 20. Torsion bar 52 extends through and forwardly of plate 84 and has a second crank element 90 (FIGS. 1 and 5) mounted thereon, the crank element 90 having a head 92 secured to the front end of torsion bar 52 and a tangential arm 94 (FIGS. 5 and 6) extending laterally from head 92 along and generally parallel with the inner surface of front end wall 20. Arm 94 generally is substantially parallel with and in proximity to the adjacent upper surface portion of bottom 14 as shown in FIG. 1.

Arm 94 has a screw 96 (FIGS. 1, 2, 5, 8 and 9) threadably coupled to it, the screw extending through arm 94 and downwardly through an opening 98 (FIGS. 2, 8 and 9) in bottom 14 near front wall 20. The screw has a head 100 on the lower end thereof, and the head has a washer 102 which is capable of engaging the lower flat surface of bottom 14 (FIGS. 8 and 9) so that the screw can serve as a stop to limit upward movement of arm 94. As shown in FIG. 2, washer 102 is above head 100, and below bottom 14. In this condition, the arm 94 can pivot upwardly away from bottom 14 through a limited angular distance when the torsion bar 52 is pivoted in a counterclockwise sense when viewing FIGS. 1 and 3. However, if washer 102 engages the lower surface of bottom 14, it locks out further angular movement of arm 94, and there can be no further upward movement of arm 94 away from bottom 14; thus, screw 96 serves to provide an adjustable stop in the handling of the torsion bar 52 as will be explained hereinafter.

Figure 8:
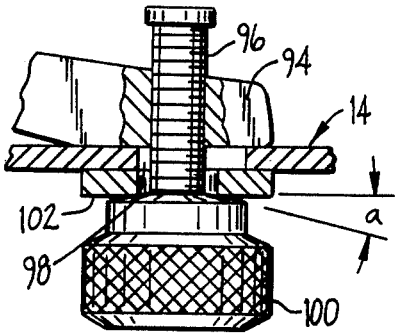
FIG. 8 is an enlarged, cross-sectional view of an adjustment member for one of the torsion bars of the lower section, showing an equilibrium position of the adjustment member.
Figure 9:
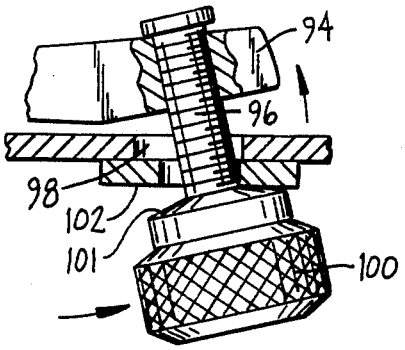
FIG. 9 is a view similar to FIG. 8 but showing the adjustment member in a position bearing against an adjacent fixed surface to limit the loading on the torsion bar to which the adjustment member is coupled.
Figure 10:
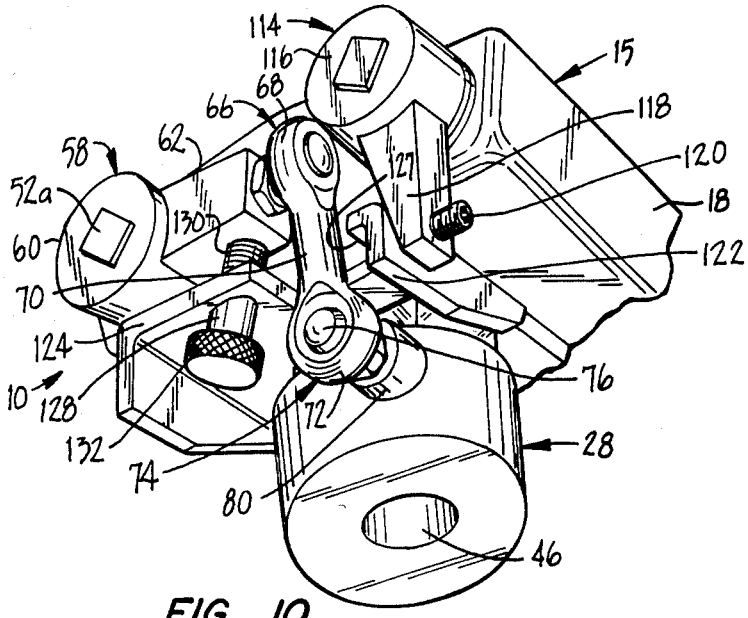
FIG. 10 is a perspective view of the rear portion of the mechanism, looking upwardly and forwardly from the rear end thereof.
Figure 11:
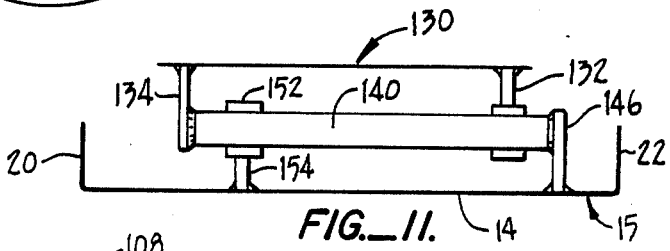
FIG. 11 is a schematic view of the mechanism showing the way in which the upper and lower sections are coupled together.

FIG. 8 shows the full locked position of screw 96 so that there can be no upward movement of arm 94. FIG. 9 shows the full upward position of arm 94 with a beveled upper surface 101 of head 100 engaging the bottom flat surface of washer 102.

Torsion bar 54 is rotatably mounted at its forward end on upright plate 84 by a bearing 104 (FIGS. 1 and 5), and this forward end of bar 54 extends forwardly of plate 84 and is coupled to a third crank element 106 having a head 108 rigidly secured to the forward end of bar 54. Crank element 106 also has an arm 110 extending tangentially thereof as shown in FIG. 1, and arm 110 has an outer end which substantially overlies and normally engages the upper surface of the outer end of arm 94. Thus, as the outer end of arm 94 is elevated due to counterclockwise movement of torsion bar 52 (when viewing FIG. 1), this movement will cause clockwise movement of arm 110 and thereby torsion bar 54 relative to plate 84.

The rear end of torsion bar 54 is pivotally mounted by a bearing 112 (FIG. 5) on rear wall 22, and the rear end of bar 54 passes through rear wall 22 and terminates exteriorly thereof. A fourth crank element 114 has a head 116 secured to the rear end of torsion bar 54. Crank element 114 further includes a downwardly extending arm 118 (FIGS. 1–3), and arm 118 has a set screw 120 near the lower end thereof, the set screw being engageable with a side flange 122 of a plate 124 secured by rivets 126 (FIG. 5) to the lower surface of bottom 14. Plate 124 has a recess 127 (FIG. 3) which permits link 70 to pass upwardly between U-joints 66 and 74 (FIG. 3). Screw 120 permits the initial angular position of the rear end of torsion bar 54 to be adjustably set relative to housing 12, thereby affecting the spring load of torsion bar 54. Thus, screw 120 serves as a pre-load adjuster.

Plate 124 (FIG. 3) has a threaded bushing 128 for threadably receiving a screw 130 having a head 132. The screw extends upwardly through plate 124 and is engageable with the lower surface of arm 62 of first crank element 58. Thus, screw 130 provides an adjustable stop for limiting the clockwise rotation of arm 62 and thereby the forward tilting of a chair coupled to mechanism 10.

The foregoing description relates to section 12 of mechanism 10 which allows forward and backward tilting movement of the mechanism and thereby a chair coupled to the mechanism. The following paragraphs will describe section 13 (FIG. 1) and the way in which it allows side-to-side tilting movement of a chair coupled to mechanism 10.

Section 13 includes a generally flat plate 130 (FIGS. 1, 2, 4 and 5) having a pair of spaced, generally flat flanges 132 and 134, flange 132 being near the rear end of margin 136 of plate 130 and flange 134 being near the front edge margin 138 of the plate. As shown, the width of the plate is greater than the width of housing 15 to facilitate the connection of plate 130 to a chair. To this end, plate 130 has holes 131 for receiving screws which serve to attach the plate to the underside of a chair. However, plate 130 need not be wider than housing 15. In such a case, bottom 14 could have holes to allow the passage of screws received into holes 131 in a narrower plate 130. Regardless of its width, plate 130 overlies housing 15 as shown in FIG. 4 and is capable of rocking about a generally horizontal axis generally parallel with torsion bars 52 and 54.

A central torsion bar 140 (FIGS. 1 and 2) is coupled with plate 130 to control the amount of tilt of the plate 130 when it rocks from side-to-side relative to housing 15. To mount the plate 130 and the rear end of torsion bar 140, a mounting member 142 (FIG. 2) is secured to an upright plate 144, such as by welding, plate 144 having a horizontal flange 145 (FIGS. 2 and 5) secured by rivets 126 to bottom 14 as shown in FIG. 2. Member 142 fixedly receives the rear end of torsion bar 140 in a manner to prevent rotation of such rear end of the torsion bar. As will hereinafter be described, the forward end of torsion bar 140 can pivot about its central axis relative to the mounting member 142.

A bushing 146 (FIG. 2) of Delrin or other suitable material is mounted on torsion bar 140 near the rear end thereof, and bushing 146 has a flange **146*a* adjacent to the front, flat face of member 142. A steel sleeve 147 is rotatably mounted over bushing 146 and has a flange 147*a* (FIG. 2) which is welded or otherwise secured to the rear flange 132 (FIG. 2) of plate 130. Thus, the rear part of plate 130 can rock or pivot relative to mounting member 142 and to the rear end of torsion bar 140 about the central axis of bar 140**.

The front end of torsion bar 140 has a bushing 150 thereon, bushing 150 having a flange **150*a* adjacent to the flange 152*a* of a steel sleeve 152 surrounding bushing 150 and secured by welding or other means to an upright plate 154 having a flange 156 secured by rivets 158 to bottom 14 as shown in FIG. 2. Thus, the front end part of torsion bar 140 and thereby plate 130 can rock about the central axis of torsion bar 140 relative to plate 154 and thereby housing 15**.

The front end **140*a* (FIG. 2) of torsion bar 140 extends into and through a mounting member 160 rigid to the front flange 134 (FIG. 1) of plate 130. Member 160 has a recess 162 (FIGS. 1 and 4) at the lower end thereof for adjustably receiving a head 164 on the upper end of a screw 166 extending through a threaded bushing 168 in bottom 14 and having a knob 170 on its lower end. The outer surface of head 164 is radiused, and recess 162 is defined by a pair of spaced legs 172 which have sloping inner surfaces for complementally engaging the outer surface of head 164. The vertical position of head 164 thereby adjustably limits the angle of rotation of the front end 140*a* of torsion bar 140 and thereby plate 130 relative to housing 15**.

With sections 12 and 13 of mechanism 10 coupled together in the manner shown in FIG. 2, mechanism 10 is ready to be secured to the flat bottom surface of a chair. To this end, screws are used through screw holes 131 and the screws pass into the chair. Screw holes 131 are accessible near the outer side margin of plate 130 as shown in FIG. 5; thus, sections 12 and 13 can first be coupled together before mechanism 10 is secured to the chair.

OPERATION

With mechanism 10 secured to the bottom surface of a chair and when shaft 44 (FIG. 2) of the chair base is received in hole 46 of mounting member 28, mechanism 10 is ready for use and a person can sit in the chair and tilt backward and forward and from side-to-side. The backward and forward tilting of the chair will be first described, following which a description of the side-to-side tilting of the chair will be set forth.

For backward and forward tilting movement, three adjustments are initially made. These adjustments include the adjustment of screw 96 (FIG. 2) to adjust the capability of arm 94 to swing upwardly and away from bottom 14 and thereby permit torsion bar 54 to affect the backward tilt of the chair; the adjustment of screw 130 to limit the clockwise rotation of the rear end of torsion bar 52 relative to its forward end to thereby limit the angle of forward tilt of the chair; and the adjustment of set screw 120 (FIG. 3) to control the counterclockwise pivotal movement of the rear end of torsion bar 54 which thereby sets the pre-load of bar 54. Typically, set screw 120 will be adjusted at the factory and, in certain cases, could be replaced by a fixed mount providing the initial twist required.

The user initially sets screw 96 to control the lack of or the degree of interaction between the spring rates of torsion bars 52 and 54 for backward tilting of the chair. For instance, if screw 96 is adjusted such that washer 102 above head 100 (FIG. 2) engages the lower surface of bottom 14, then arm 94 of second crank element 92 cannot move upwardly; thus, the backward tilting movement will be subject only to the spring rate of torsion bar 52. Thus, when the seat is tilted rearwardly, mechanism 10 pivots about the axis of pin 30 (FIG. 2) and the linkage 70 (FIG. 3) causes arm 62 of first element 58 to pivot in a counterclockwise sense when viewing FIG. 3, thereby twisting torsion bar 52 in a counterclockwise sense relative to bottom 14. Since arm 94 cannot move, only the spring rate of torsion bar 52 will control or limit this backward tilting of the chair.

In the event that screw 96 is adjusted such that washer 102 above head 100 (FIG. 2) is backed off as shown in FIG. 2, backward tilting of the chair allows torsion bar 52 to twist in a counterclockwise sense when viewing FIG. 3, while, at the same time, allowing arm 94 (FIG. 1) to pivot upwardly away from bottom 14. Since arm 94 engages arm 110, arm 110 is rotated upwardly in a clockwise sense when viewing FIG. 1 to, in turn, twist or pivot the front end of torsion bar 54 in the same direction. Thus, during this time, both torsion bars contribute to the spring bias action arising due to the tilting rearwardly of the chair. This continues until washer 102 above head 100 on screw 96 engages bottom 14 (FIG. 9), at which time, the spring rate of torsion bar 54 will have no further effect, and continued rearward movement of the chair will be under the influence of the spring characteristics of torsion bar 52 alone. Thus, it can be seen that adjustment of the angular degree of backward tilt of the chair can be made over a wide range, it being understood that torsion bar 52 alone can serve to provide the spring characteristic or, depending upon the adjustment of screw 96, both torsion bars 52 and 54 can be incorporated for this same purpose.

The setting of screw 130 (FIG. 3) will determine the amount by which the chair can tilt forwardly. If head 132 on screw 130 engages the bottom of bushing 128, then there can be no forward tilt of the chair because, for forward tilt, the rear end of torsion bar 52 must twist in a clockwise sense when viewing FIG. 3 relative to the front end of the torsion bar 52. The front end cannot pivot relative to bottom 14 in a clockwise sense when viewing FIG. 3 because arm 94 (FIG. 1) is in engagement with bottom 14 when the chair is in equilibrium, i.e., when there is no forward or rearward tilt of the chair. By backing off head 132 from bushing 128, screw 130 will be separated from arm 62 and the latter can move downwardly in a clockwise sense when viewing FIG. 3 to provide for forward tilt. Thus, mechanism 10 thereby provides both forward and rearward tilt of the chair, the forward tilt being under the influence of the spring rate of torsion bar 52 alone and the rearward tilt being under the influence of torsion bar 52 alone or in combination with torsion bar 54.

To tilt the chair from side-to-side, the person in the chair either leans or shifts his weight to one side or the other. In doing so, plate 130 rocks relative to housing 15 to the respective side. This rocking action is under the influence of the spring rate of torsion bar 140 because the front end of torsion bar 140 is coupled by member 160 to plate 130 while the rear end of the torsion bar is secured to support member 142 rigid by means of plate 144 to bottom 14 (FIG. 2). Thus, plate 130 will rock about the longitudinal or central axis of torsion bar 140 so as to be under the influence of the spring characteristics of torsion bar 140. The spring bias force of torsion bar 140 will return plate 130 to its equilibrium position shown in FIG. 4. The sloping upper margins 24 and 26 of front and rear walls 20 and 22 of housing 15 are provided to allow rocking of plate 130 from side-to-side without interference with housing 15.

Mechanism 10 provides a tilting mechanism which is simple and rugged in construction, can be quickly and easily secured to a chair and to a base. Mechanism 10 permits adjustments in immediate forward and rearward tilting of the chair with a minimum of effort. The wide range of adjustments permitted for rearward tilting of the chair renders the mechanism highly efficient and adaptable for persons of different sizes and weights, all of which can be achieved while permitting the chair to which the mechanism is secured to tilt from side-to-side as well as forward and backward. Mechanism 10 has a minimum of moving parts and is suitable for attachment to a wide variety of chairs yet the production cost of the mechanism is minimal considering the long useful life of the mechanism.

Figure 12:
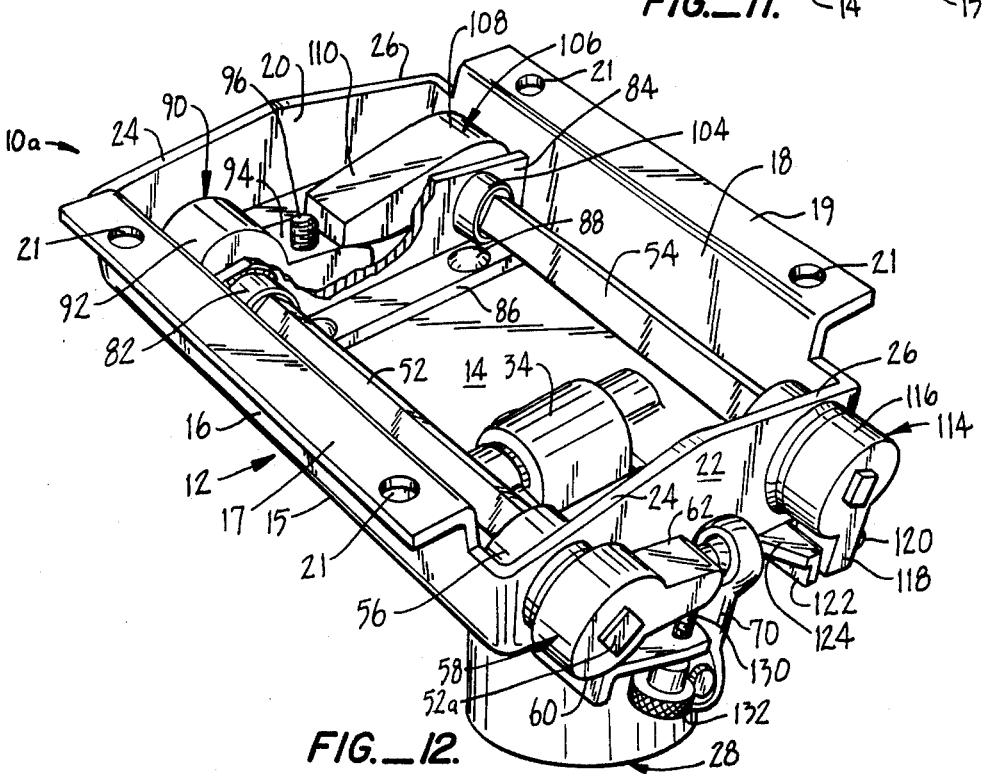
FIG. 12 is a view similar to FIG. 1 but showing a second embodiment of the mechanism in which the upper section is not used.

FIG. 12 shows a second embodiment of the mechanism of this invention. This embodiment, denoted by the numeral 10*a*, is similar in construction to mechanism 10 except that, while mechanism 10*a* has a lower section 12, it has no upper section 13 as does mechanism 10. Instead, housing 15 of mechanism 10*a* has a pair of side flanges 17 and 19 at the upper marginal edges of sides 16 and 18. Flanges 17 and 19 have holes 21 which receive screws for attaching the flanges to the flat bottom surface of a chair.

Mechanism 10*a* allows the chair to pivot forwardly and rearwardly as described above with respect to mechanism 10. However, the chair cannot pivot from side-to-side because mechanism 10*a* has no means providing for such movement.

Figure 13:
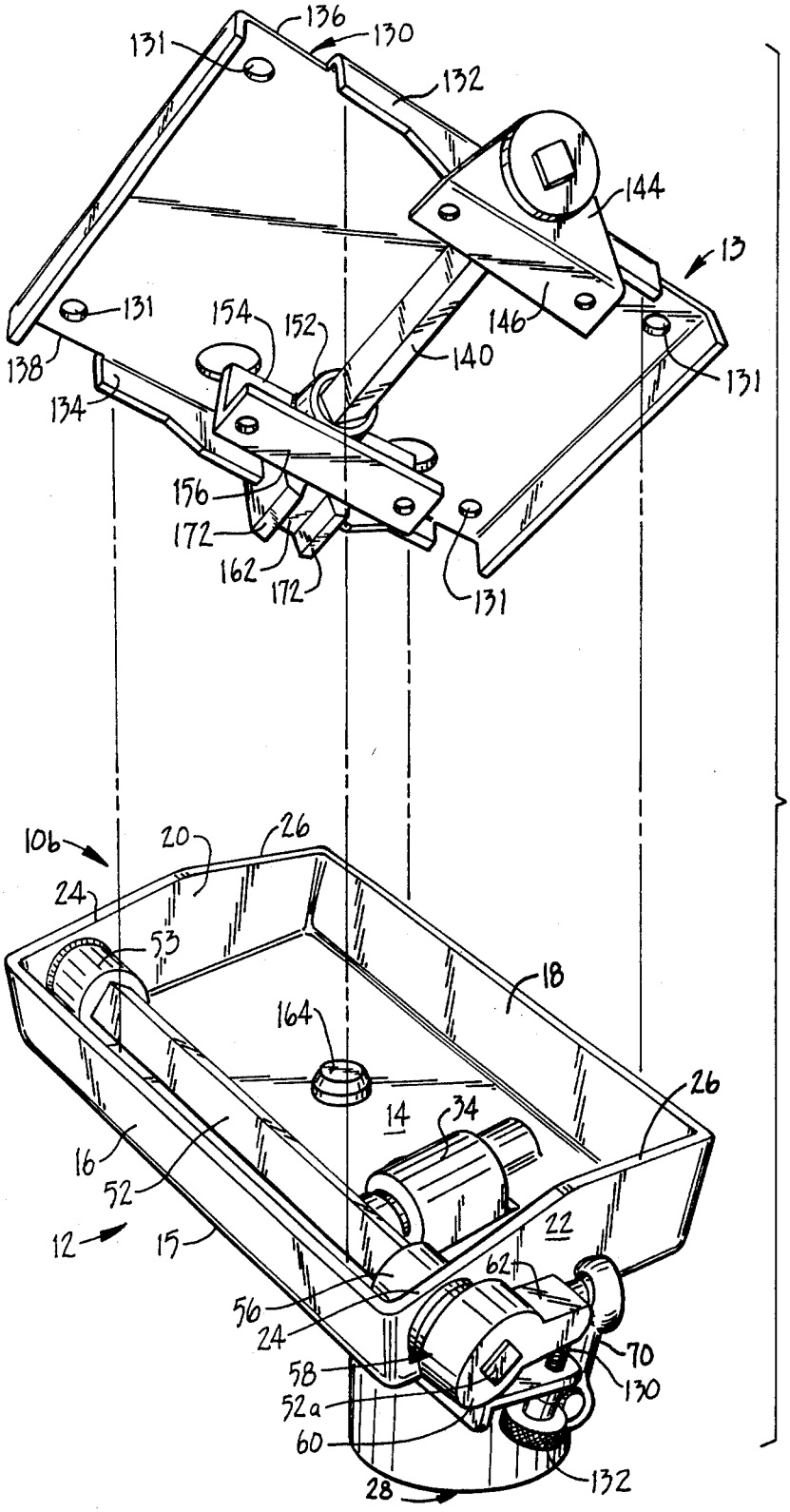
FIG. 13 is a view similar to FIG. 1 but showing a third embodiment of the mechanism with only a single torsion bar to control backward and forward tilt instead of a pair of torsion bars as provided in the embodiment of FIG. 1.

FIG. 13 shows a third embodiment of the mechanism of this invention. This embodiment, denoted by the numeral 10*b*, is similar in construction as mechanism 10 of FIG. 1 except that mechansm 10*b* has no torsion bar 54. Thus, forward and rearward tilt of a chair coupled with mechanism 10*b* is affected only by the spring rate of torsion bar 52. In all other respects, mechanism 10*b* operates in substantially the same manner as mechanism 10 in providing for forward and rearward tilting and side-to-side tilting of a chair coupled to mechanism 10*b*.

In mechanism 10*b*, a number of components required in mechanism 10 are clearly eliminated. For instance, plate 84 (FIGS. 2 and 5) is no longer needed since arm 94 is not required. Thus, the forward end of torsion bar 52 is rigidly secured by a bushing 53 fixed to the rear face of front wall 20. Also, other components relating to torsion bar 54 of mechanism 10 are no longer needed. Among these last-mentioned components are bearing 112 and crank element 114.

What is claimed is:

1. A tilting mechanism for a chair having a base comprising: a support; first means on the support for pivotally coupling the support to the base for pivotal movement about a horizontal axis; second means on the support for coupling the support to the chair; and torsion bar means extending transversely of said axis for providing a spring bias force exerted on the support when the support is pivoted in either of a pair of opposed directions relative to the base and when the support is coupled to the base.

2. A mechanism as set forth in claim 1, wherein said torsion bar means includes a torsion bar having means at one end thereof for fixedly coupling the one end to the support and the other end capable of being pivoted relative to the support, said other end being coupled to said first means.

3. A mechanism as set forth in claim 2, wherein is included a crank element coupled to said torsion bar adjacent to said other end thereof and to said first means.

4. A mechanism as set forth in claim 1, wherein said first means includes a pivot pin permitting the support to pivot in opposite directions about said generally horizontal axis, and means for coupling the pin to the base.

5. A mechanism as set forth in claim 1, wherein is included an adjustable stop mounted on the support for limiting the pivotal movement of said torsion bar means in one of said directions.

6. A mechanism as set forth in claim 1, wherein the torsion bar means includes a pair of torsion bars on the support, the ends of a first of the torsion bars being pivotally coupled with the support, one end of the second torsion bar being pivotally mounted on the support and the other end of the second torsion bar being fixed to the support, and means coupling the one end of the second torsion bar with one end of the first torsion bar, whereby pivotal movement of said first torsion bar will be transferred to the second torsion bar and the torsion bars will pivot as a unit relative to the support to provide said spring bias force.

7. A mechanism as set forth in claim 6, wherein the means coupling the ends of the torsion bars includes an adjustable stop operable to limit the pivotal movement of the one end of the second torsion bar relative to the support.

8. A mechanism as set forth in claim 6, wherein the other end of the second torsion bar has means adjustably fixing said other end to the support.

9. A mechanism as set forth in claim 1, wherein said second means comprises a plate on the support for attachment to the chair.

10. A mechanism as set forth in claim 9, wherein the plate is pivotally mounted on the support for permitting tilting movement of the chair from side-to-side relative to the support, the first means permitting tilting of the chair about a generally horizontal axis, and including second torsion bar means coupled with said plate for providing a spring bias force exerted on the plate when the plate is displaced to either side of an equilibrium position, said second torsion bar means extending longitudinally of the first-mentioned torsion bar means.

11. A mechanism as set forth in claim 10, wherein the plate can pivot from side-to-side as the support pivots about the horizontal axis.

12. A mechanism as set forth in claim 10, wherein the second torsion bar means has a first end fixed to the support and a second end coupled to the plate.

13. A mechanism as set forth in claim 12, wherein is included means coupled with the plate for limiting the angle of pivotal movement thereof in opposite directions.

14. A mechanism as set forth in claim 13, wherein said limiting means includes a screw adjustably mounted on the support.

15. A tilting mechanism for a chair having a base comprising: a support; first means on the support for pivotally coupling the support to the base for movement relative to the base forwardly and backwardly; second means on the support for pivotally coupling the support to the chair for movement of the chair from side-to-side relative to the support; a first torsion bar providing a spring bias force exerted on the support when the support is pivoted forwardly or backwardly relative to the base as the support is coupled to the base; and a second torsion bar providing a spring bias force exerted on said second means when the second means is pivoted to either side relative to the support, said third means and said fourth means extending longitudinally of each other, the torsion bars extending longitudinally of each other.

16. A mechanism as set forth in claim 15, wherein said first torsion bar having means at one end thereof to fixedly couple said one end to the support and the other end capable of being pivoted relative to the support, said other end being coupled to said first means.

17. A mechanism as set forth in claim 15, wherein said first means includes a pivot pin permitting the support to pivot in opposite directions about a generally horizontal axis, and means coupling the pin to the base.

18. A tilting mechanism for a chair having a base comprising: a support; a pivot pin on the support; means for coupling the pin to the base to permit the support to pivot in opposite directions about a generally horizontal axis for pivotally coupling the support to the base; second means on the support for coupling the support to the chair; torsion bar means extending transversely of the axis of pivotal movement of the support bar for providing a spring bias force exerted on the support when the support is pivoted in either of a pair of opposed directions relative to the base and when the support is coupled to the base; and an adjustable stop mounted on the support for limiting the pivotal movement of said torsion bar means in one of said directions, said torsion bar means including a torsion bar having means at one end thereof for fixedly coupling said one end to the support and the other end capable of being pivoted relative to the support, there being a crank element coupled to said other end of the torsion bar and extending laterally therefrom, a mounting member for connection to the base, and a link pivotally coupling the crank element to the mounting member, said stop being adjustably carried by the support and being engageable with the crank element.

19. A tilting mechanism for a chair having a base comprising: a support; first means on the support for pivotally coupling the support to the base; second means on the support for coupling the support to the chair; and torsion bar means providing a spring bias force exerted on the support when the support is pivoted in either of a pair of opposed directions relative to the base and when the support is coupled to the base, the torsion bar means including a pair of torsion bars on the support, the ends of a first of the torsion bars being pivotally coupled with the support, one end of the second torsion bar being pivotally mounted on the support and the other end of the second torsion bar being fixed to the support, and means coupling the one end of the second torsion bar with one end of the first torsion bar, whereby pivotal movement of said first torsion bar will be transferred to the second torsion bar and the torsion bars will pivot as a unit relative to the support to provide said spring bias force, said means coupling the ends of the torsion bars including an adjustable stop operable to limit the pivotal movement of the one end of the second torsion bar relative to the support, said means coupling the ends of the torsion bars further including a crank element on said one end of each of the torsion bars, respectively, the outer ends of the crank elements being engageable with each other, said stop including a screw adjustably carried by the crank element of one of the torsion bars, said screw having head means engageable with the support when the first torsion bar is pivoted relative to the support through an angular distance, the second torsion bar being prevented from pivoting further when the head means engages the support.

20. A tilting mechanism for a chair having a base comprising: a support; first means on the support for pivotally coupling the support to the base; second means on the support for coupling the support to the chair; and torsion bar means providing a spring bias force exerted on the support when the support is pivoted in either of a pair of opposed directions relative to the base and when the support is coupled to the base, the torsion bar means including a pair of torsion bars on the support, the ends of a first of the torsion bars being pivotally coupled with the support, one end of the second torsion bar being pivotally mounted on the support and the other end of the second torsion bar having means adjustably fixing said other end to the support, and means coupling the one end of the second torsion bar with one end of the first torsion bar, whereby pivotal movement of said first torsion bar will be transferred to the second torsion bar and the torsion bars will pivot as a unit relative to the support to provide said spring bias force, said adjustable fixing means including a crank element on the other end of said second torsion bar, said crank element having a screw adjustably mounted thereon, said screw normally engaging the support to provide an initial spring bias force exerted by the second torsion bar on said first torsion bar.

21. A tilting mechanism for a chair having a base comprising: a support; first means on the support for pivotally coupling the support to the base; second means including a plate on the support for coupling the support to the chair, the plate being pivotally mounted on the support for permitting tilting movement of the chair from side-to-side relative to the support, the first means permitting tilting of the chair about a generally horizontal axis, the plate being pivotal from side-to-side as the support pivots about the horizontal axis, there being means coupling the plate to the support to provide a spring bias force exerted on the plate when the plate is displaced to one side relative to the support, the spring bias force means including a torsion bar having a first end fixed to the support and a second end coupled to the plate, there being a screw adjustably mounted on the support and coupled with the plate for limiting the angle of pivotal movement thereof in opposite directions, the torsion bar having a mounting member thereon at the opposite end thereof, said mounting member having a recess adjacent to the support, said screw having a head adjustably received within said recess; and torsion bar means providing a spring bias force exerted on the support when the support is pivoted backward relative to the base and when the support is coupled to the base.

22. A tilting mechanism for a chair having a base comprising: a support; first means on the support for pivotally coupling the support to the base for movement relative to the base forwardly and backwardly; second means on the support for pivotally coupling the support to the chair for movement of the chair from side-to-side relative the support; a torsion for providing a spring bias force exerted on the support when the support is pivoted forwardly or backwardly relative to the base as the support is coupled to the base, said torsion bar having means at one end thereof to fixedly couple said one end to the support and the other end capable of being pivoted relative to the support, said other end being coupled to said first means, there being a crank element coupled to said torsion bar adjacent to said other end thereof and to said first means; and fourth means providing a spring bias force exerted on said second means when the second means is pivoted to either side relative to the support, said third means and said fourth means extending longitudinally of each other.

23. A tilting mechanism for a chair having a base comprising: a support; a pivot pin; means coupling the pin to the support and the base for pivotally coupling the support to the base for movement relative to the base forwardly and backwardly about a generally horizontal axis; second means on the support for pivotally coupling the support to the chair for movement of the chair from side-to-side relative to the support; a torsion bar providing a spring bias force exerted on the support when the support is pivoted forwardly or backwardly relative to the base as the support is coupled to the base; and fourth means providing a spring bias force exerted on said second means when the second means is pivoted to either side relative to the support, said third means and said fourth means extending longitudinally of each other.

24. A mechanism as set forth in claim 23, wherein is included an adjustable stop mounted on the support for limiting the forward pivotal movement of said torsion bar.

25. A mechanism as set forth in claim 24, wherein said torsion bar has means at one end thereof for fixedly coupling said one end to the support and the other end capable of being pivoted relative to the support, and including a crank element coupled to said other end of the torsion bar and extending laterally therefrom, a mounting member for connection to the base, and a link pivotally coupling the crank element to the mounting member, said stop being adjustably carried by the support and being engageable with the crank element.

26. A tilting mechanism for a chair having a base comprising: a support; first means on the support for pivotally coupling the support to the base for movement relative to the base forwardly and backwardly; second means on the support for pivotally coupling the support to the chair for movement of the chair from side-to-side relative to the support; third means providing a spring bias force exerted on the support when the support is pivoted forwardly or backwardly relative to the base as the support is coupled to the base; and fourth means providing a spring bias force exerted on said second means when the second means is pivoted to either side relative to the support, said third means and said fourth means extending longitudinally of each other, the third means and the fourth means including a pair of torsion bars on the support, respectively, the ends of a first of the torsion bars being pivotally coupled with the support, one end of the second torsion bar being pivotally mounted on the support and the other end of the second torsion bar being fixed to the support, and means coupling and the torsion bars will pivot as a unit relative to the the one end of the second torsion bar with one end of the first torsion bar, whereby pivotal movement of said first torsion bar will be transferred to the second torsion bar and the torsion bars will pivot as a unit relative to the support to provide said spring bias force.

27. A mechanism a set forth in claim 26, wherein the means coupling the ends of the torsion bars includes an adjustable stop to limit the pivotal movement of the one end of the second torsion bar relative to the support.

28. A mechanism as set forth in claim 27, wherein said means coupling the ends of the torsion bars includes a crank element on the one end of each of the torsion bars, respectively, the outer ends of the crank elements being engageable with each other, said stop including a screw adjustably carried by the crank element of said first torsion bar, said screw having head means engageable with the support when the first torsion bar is pivoted relative to the support through an angular distance, the second torsion bar being locked out when the head means engages the support.

29. A mechanism as set forth in claim 26, wherein the other end of the second torsion bar has means adjustable fixing said other end to the support.

30. A mechanism as set forth in claim 29, wherein the other end of said second torsion bar has a crank element thereon, said crank element having a screw adjustably mounted thereon, said screw normally engaging the support to provide an initial spring bias force exerted by the second torsion bar on said first torsion bar.

31. A tilting mechanism for a chair having a base comprising: a support; first means on the support for pivotally coupling the support to the base for movement relative to the base forwardly and backwardly; second means including a plate on the support for pivotally coupling the support to the chair for movement of the chair from side-to-side relative to the support; third means providing a spring bias force exerted on the support when the support is pivoted forwardly or backwardly relative to the base as the support is coupled to the base; and fourth means providing a spring bias force exerted on the plate when the plate is pivoted to either side relative to the support, said third means and said fourth means extending longitudinally of each other.

32. A mechanism as set forth in claim 31, wherein the plate is pivotally mounted on the support for permitting tilting movement of the chair from side-to-side relative to the support, the first means permitting tilting of the chair about a generally horizontal axis.

33. A mechanism as set forth in claim 32, wherein the plate is pivotal from side to side as the support pivots about the horizontal axis.

34. A mechanism as set forth in claim 31, wherein the fourth means includes a torsion bar having a first end fixed to the support and a second end coupled to the plate.

35. A mechanism as set forth in claim 31, wherein is included means engageable with the plate for adjustably limiting the angle of pivotal movement thereof in opposite directions.

36. A mechanism as set forth in claim 35, wherein said limiting means includes a screw adjustably mounted on the support and engageable with the plate.

37. A mechanism as set forth in claim 36, wherein the fourth means includes torsion bar having a mounting member thereon at one end thereof, said one end of the torsion bar being pivotal relative to the support, said mounting member having a recess adjacent to the support, said screw having a head adjustably received within said recess.

38. A tilting mechanism for a chair having a base comprising: a support; first means on the support for pivotally coupling the support to the base for movement relative to the base forwardly and backwardly; second means on the support for pivotally coupling the support to the chair for movement of the chair from side-to-side relative to the support; a first torsion bar providing a spring bias force exerted on the support when the support is pivoted forwardly or backwardly relative to the base as the support is coupled to the base; and a second torsion bar providing a spring bias force exerted on said second means when the second means is pivoted to either side relative to the support, said third means and said fourth means extending longitudinally of each other.

* * * * *